US007048218B2

(12) United States Patent
Hunag

(10) Patent No.: US 7,048,218 B2
(45) Date of Patent: May 23, 2006

(54) SHREDDER BLADE MADE BY PUNCHING AND BENDING

(75) Inventor: Simon Hunag, SanChung (TW)

(73) Assignee: Michilin Prosperity Co., Ltd., Sanchung ( * ) Notice: Subject to any disclaimer, the term of this patent is extended or adjusted under 35 U.S.C. 154(b) by 166 days.

(21) Appl. No.: 10/721,421

(22) Filed: Nov. 26, 2003

(65) Prior Publication Data

US 2005/0109866 A1 May 26, 2005

(51) Int. Cl.
*B02C 18/16* (2006.01)

(52) U.S. Cl. ..... 241/295

(58) Field of Classification Search ..... 241/295, 241/236

See application file for complete search history.

(56) References Cited

U.S. PATENT DOCUMENTS 5,141,168 A * 8/1992 Pepper ..... 241/236
6,390,400 B1 * 5/2002 Huang ..... 241/295

* cited by examiner

*Primary Examiner*—Mark Rosenbaum
(74) *Attorney, Agent, or Firm*—Dennison, Schultz, Dougherty & MacDonald

(57) ABSTRACT

Disclosed is a shredder blade made by punching and bending that is integrally made by punching a metal sheet having a thickness of about 0.6 mm by a punching die to form a circular blade body, where the circular blade is formed into a serrated cutting edge around it periphery, and symmetrical cutting portions, connecting portions and supports extending outwards from a top and a bottom transections of the blade body, wherein the cutting portions, connecting portions and supports are first pressed towards a first direction such that they protrude from a major side of the blade body, and the cutting portions and connecting portions are bent towards an opposing second direction to form cutting edges. Relative movements of the cutting edges cut paper along a longitudinal direction to form strips. The cutting edges then cut the strips along a horizontal direction to fragment the strips into chips, to effectively reduce the material cost and the weigh of the blade to thereby reduce the motor loading and power consumption, while enhancing market competitiveness of the shredders having the blades enhance the market competitiveness.

2 Claims, 5 Drawing Sheets

SHREDDER BLADE MADE BY PUNCHING AND BENDING

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Filed of the Invention

This invention relates to an improvement of a cutting blade for use in shredders, particular to one that is integrally made from a metal sheet by a punching die and mechanical bending.

2. Background of the Invention

The conventional shredders for cutting paper use a plurality of cutting blades and spacers engaging over a rotary shaft, and the shearing force that two parallel and opposite rotary cutter shafts produce for transferring and cutting the paper-to-be-cut along a longitudinal direction into strips. Shredders can be classed into two types, the stripe-cut shredders and crosscut shredders, according to the machine cutting style. The former shredders arrange cutting blades to the rotating cutter shafts in a manner to cutting the paper in a longitudinal direction into strips. The later shredders include blades that have more than one cutting edge part, and each cutter is disposed helically along the rotary cutter shaft for first cutting paper along a horizontal direction into strips and then cutting paper along a longitudinal direction into approximate 4 mm×40 mm paper chips.

By referring to the assembled perspective view of a conventional blade illustrated in FIG. 1 and a planar view showing the operation of the conventional blade in FIG. 2, the conventional blade is made of a sheet metal having a thickness of approximately 2 mm into a blade body having a circular periphery by a punching die. The blade includes a polygonal central hole A1 through which a rotary shaft may pass. The blade also includes cutting edges A2 that are spaced in 120 degrees apart around the periphery. As shown, when two blades are arranged on the rotary shafts B in a back-to-back manner to combine into a set of blades A, the cutting edges of the two blades assume a V-like cutting edge A3. The opposite rotary shafts B' space the two blades apart by space rings (not shown) in a face-to-face manner to form a set of blade A'. When the paper-to-be-cut passes through the two reverse rotary shafts B, B', the opposing rotation of the periphery of the blades, that is, cutting edges A4 and cutting edges A4, will cut the paper like scissors. The opposing rotation of cutting edges A2 and the opposite cutting edges A4 will then cut the paper along a horizontal direction into 4 mm×40 mm paper chips.

During operation of the conventional blades, to ensure smooth cutting of the paper along the horizontal direction, sharp blades with proper orientations are needed. However, because the blades are made by a punching die, the die wear that increases with the time will reduce sharpness of the blade edges, which does not improve until replacing the mold, to result in inconsistent quality. To ensure quality of the blades, it is necessary to shorten the service term of the mold, which results in increment of the cost. In addition, in the conventional blades, the thickness of the blade is the same as the width of paper-to-be-cut. To ensure the strength of blades while cutting along the horizontal direction, the blades cannot be too thin, or else the blades tend to deform or fracture. Such a limitation attributes to the high material cost, which is less competitive as compared to the current market price.

SUMMARY OF THE INVENTION

In view of the above, the inventor thinks over an improved shredder blade that can overcome the disadvantages of the conventional shredder blades and creates a shredder blade made by punching and bending through longtime study and test.

The main objective of the present invention is to provide a shredder blade made by punching and bending, that is integrally made of a metal sheet by a punching die and mechanical bending to effectively reduce the material cost and the weigh of the blade to thereby reduce the motor loading and power consumption.

To realize the above objective, in the present invention, a sheet metal having a thickness of about 0.6 mm is punched by a punching die to form a blade body having a circular periphery, where the circular periphery is formed with a serrated cutting edge therearound. The blade includes symmetrical cutting portions, connecting portions and supports extending outwards from a top and a bottom transections of the blade body, wherein the cutting portions, connecting portions and supports are first pressed towards a first direction such that they protrude from a major side of the blade body, and the cutting portions and connecting portions are bent towards an opposing second direction to form cutting edges. Relative movements of the cutting edges cut paper along a longitudinal direction to form strips. The cutting edges then cut the strips along a horizontal direction to fragment the strips into chips.

DESCRIPTION OF THE PREFERRED EMBODIMENT

The present invention will be described in further detail hereinafter, with reference to accompanying drawings.

Figure 1:
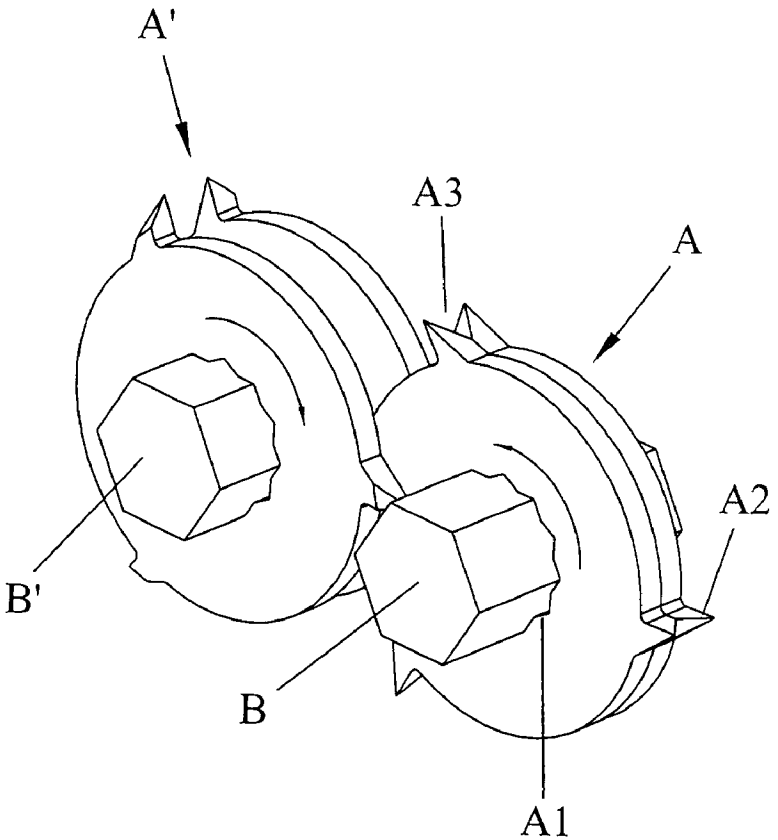
Fig. 1 Prior Art
FIG. 1 is an assembled perspective of a conventional shredder.
Figure 2:
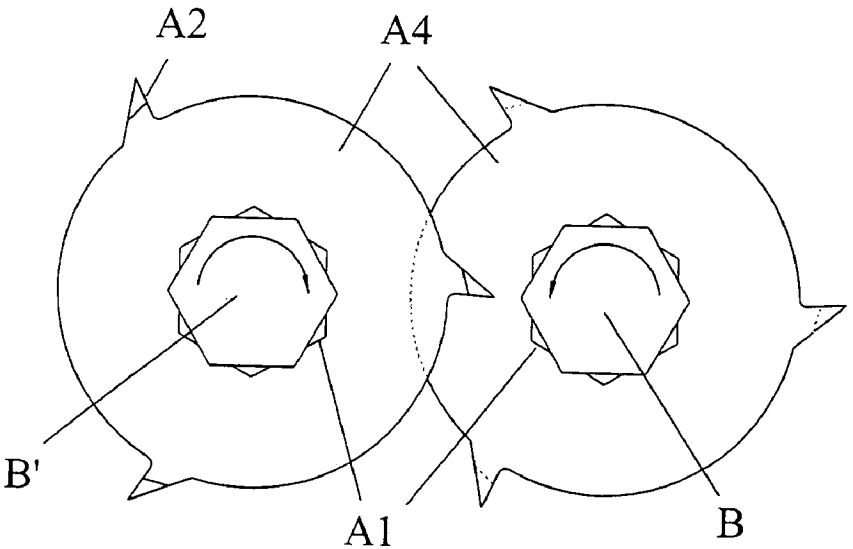
Fig. 2 Prior Art
FIG. 2 is a planar view of a conventional shredder in operation.
Figure 3B:
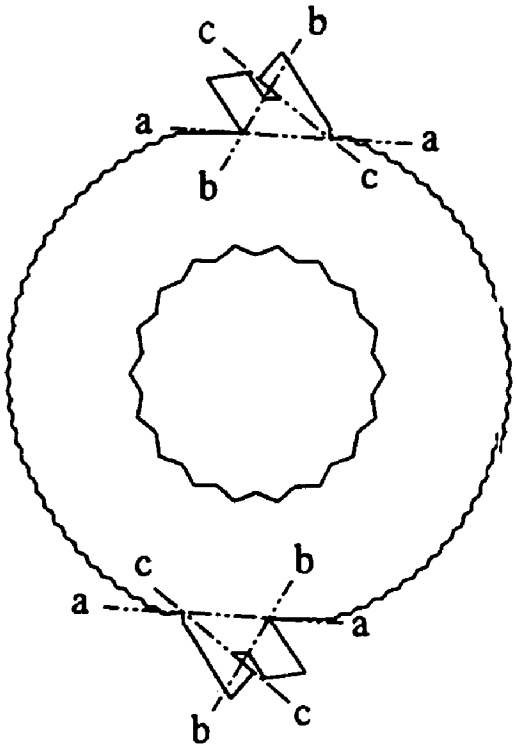
FIG. 3B is a schematic view illustrating the blade of this invention where the bending lines are shown in a leveled state.
Figure 3A:
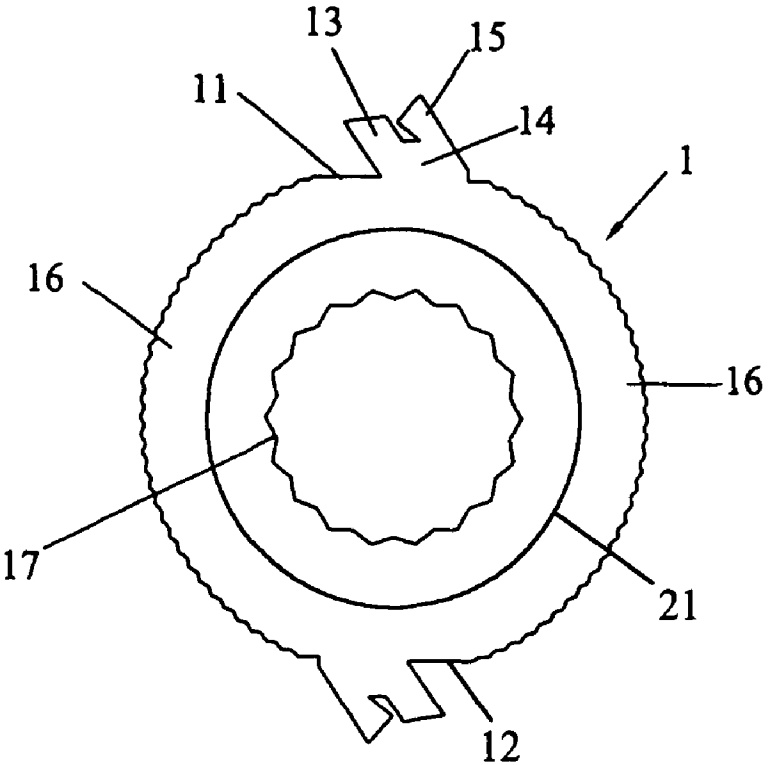
FIG. 3A is a schematic view illustrating the blade of this invention in a leveled state.

FIG. 3A illustrates a leveled state of the blade of this invention, where a blade body 1 having a circular periphery is integrally made of a metal sheet having a thickness of about 0.6 mm by a punching die. The blade body is formed with a top and a bottom transections 11, 12 on the circular periphery, and horizontally symmetrical cutting portions 13, connecting portions 14 and supports 15 extending outwards from the transections 11, 12. The remaining periphery of the blade body 1 is further formed into a serrated cutting edge 16. The relative movements of the serrated cutting edge 16 serve to pull the paper-to-be-shredded downwards and to cut the paper along a longitudinal direction into strips. The blade body 1 is formed with a polygonal central hole 17 through which a rotary shaft may pass. To enhance the bending resistance capability of the blade body, an annular crease 21 may be punched along an inbound of the circular periphery while punching the blade.

Figure 4:
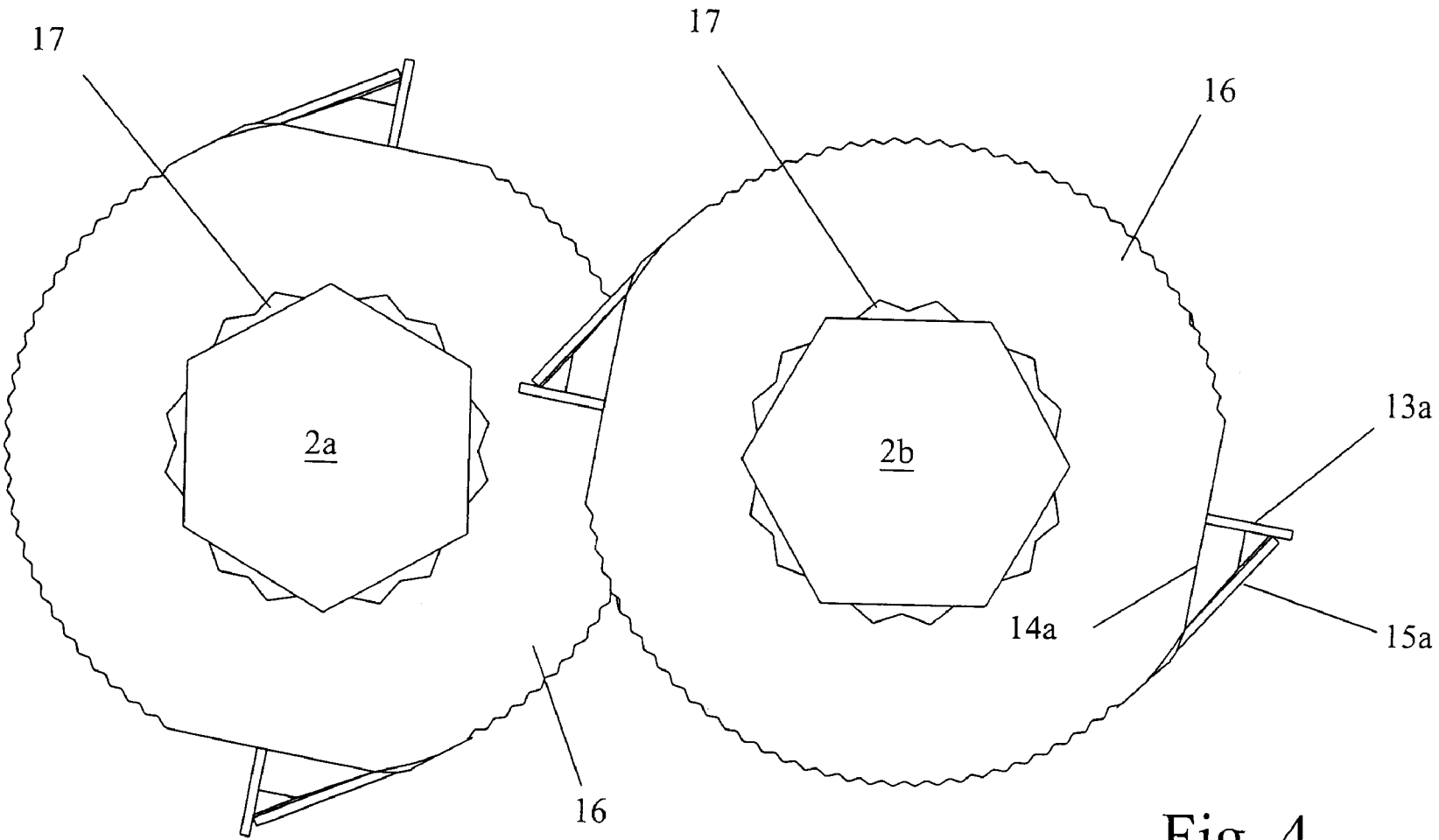
FIG. 4 is a schematic view illustrating the cutting operation of the blade of this invention.

FIG. 3B is a schematic view illustrating bending lines a—a, b—b and c—c. The cutting portions 13, connecting portions 14 and supports 15 are first pressed towards a first direction along the bending lines a—a such that the cutting portions 13, connecting portions 14 and supports 15 protrude from a major side of the toll body 1. The cutting portions and supports 15 are then bent towards an opposing second direction along the bending lines b—b and c—c, such that the resulting cutting edges, while viewed from the front, are substantially configured into a right triangle. With reference to FIG. 4, while viewing from the front, the cutting portions 13 that have been bent towards the opposing second direction to form a long side 13*a* of the right triangle is normal to the transections 11, 13 of the blade body 1 and serves to cut strips along a horizontal direction. The supports 15 that have been bend towards the opposing second direction to form a hypotenuse 15*a* of the right triangle support of the cutting portions 13 along an oblique direction. The short sides 14*a* where the connecting portions 14 are located serve as base of the cutting portions 13 and supports 15.

Figure 5:
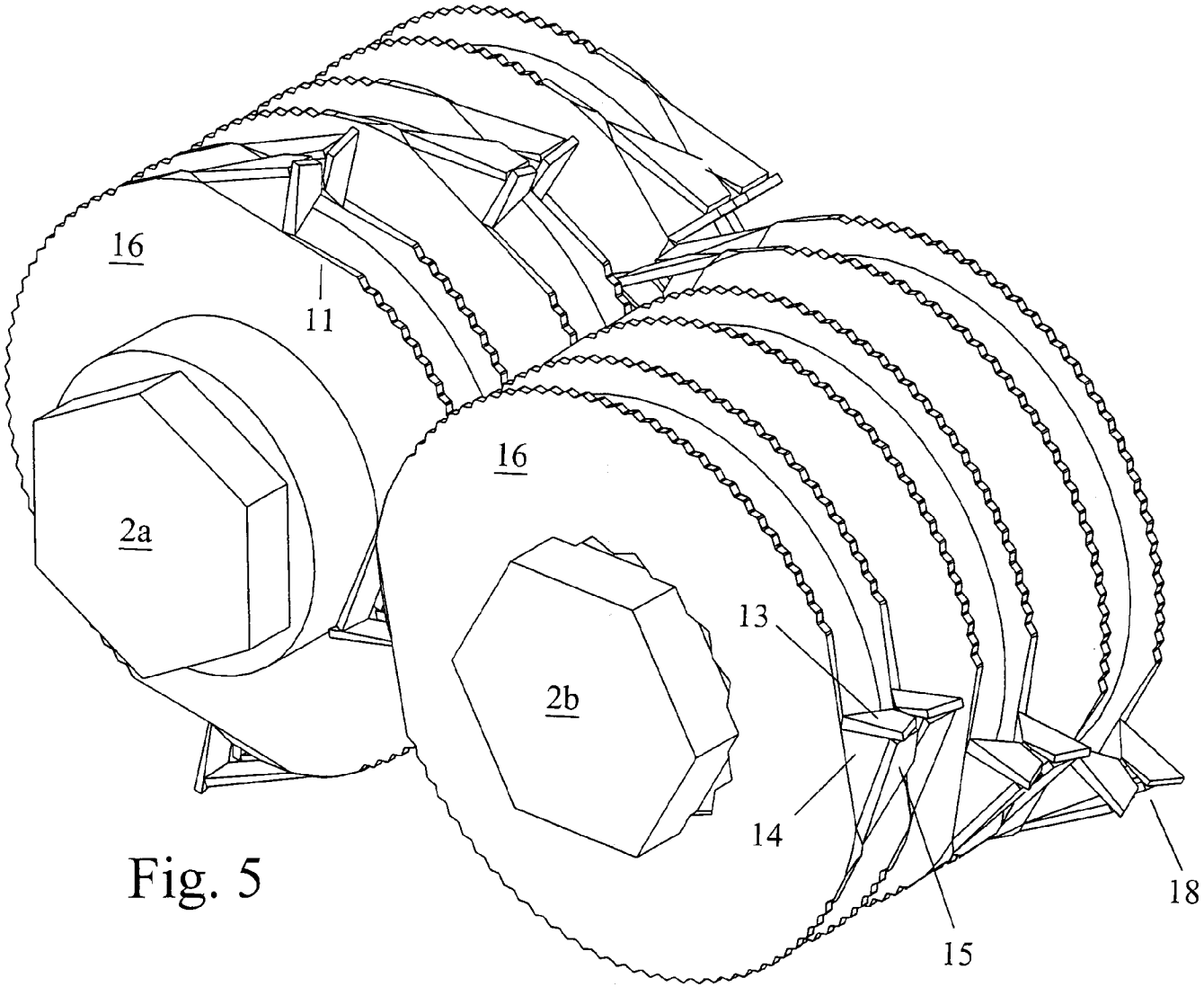
FIG. 5 is perspective view illustrating the blades of this invention after being assembled to a rotary shaft.
Figure 6:
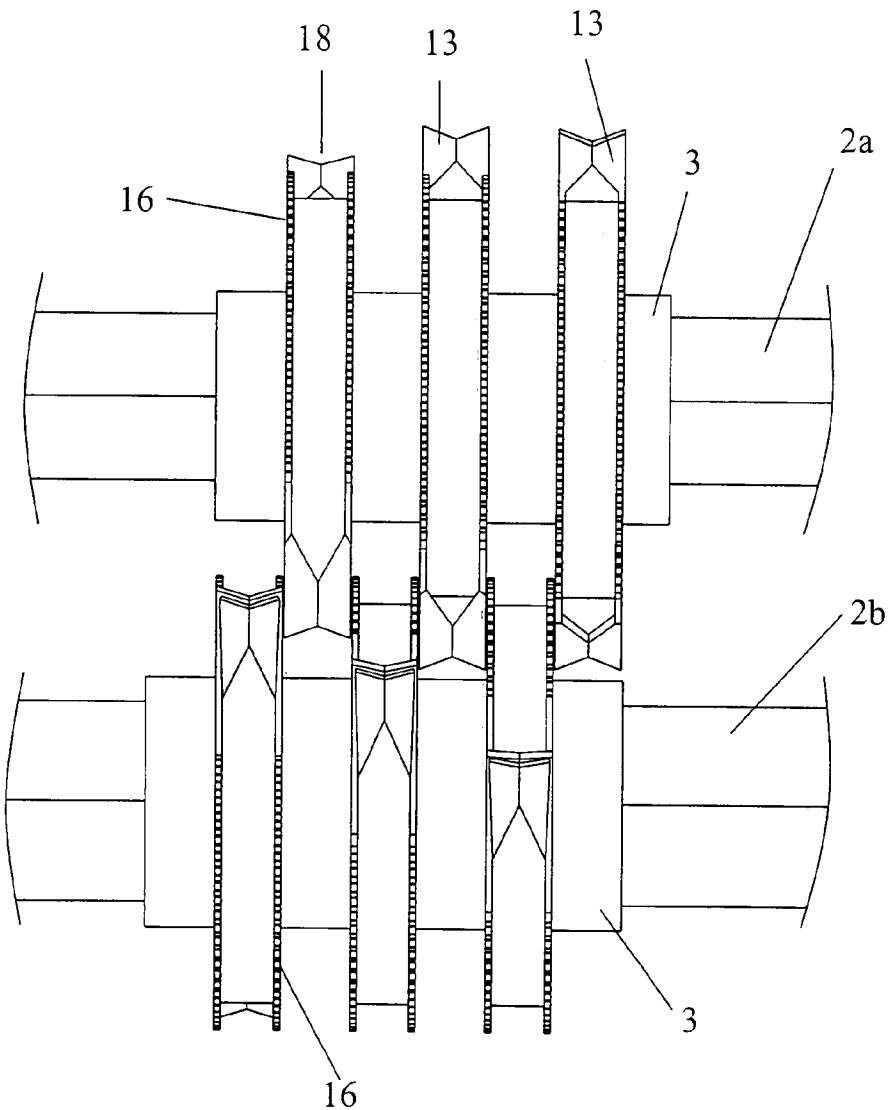
FIG. 6 is a planar view illustrating the blades of this invention after being assembled to a rotary shaft.

With reference to FIGS. 5 and 6, a first rotary shaft 2*a* located on the top is mounted with standardized blades 1, where the cutting edges of two blades are arranged on the rotary shaft 2*a* in a back-to-back manner to combine into a blade assembly having V-like cutting edges 18. Neighboring blades are sequentially arranged and spaced apart by space rings 3. A rotary shaft 2*b* located on the bottom are arranged such that blades thereto alternate with the blades mounted to the first rotary shaft 2*a*. When the blades mounted to the two rotary shafts 2*a*, 2*b* rotate in a reverse direction serve to cut paper along a longitudinal direction into strips, and the V-like cutting edges 18 cut the strips along a horizontal direction to fragment the strips into chips.

Because the conventional blades are made by punching a metal sheet having a thickness of about 2 mm, while the blades according this invention are made by punching and bending a metal sheet having a thickness of about 0.6 mm by a punching die and mechanical bending, to effectively reduce the material cost and the weigh of the blades to thereby reduce the motor loading and power consumption required for driving the shredders, increase service-life of the motor, while enhancing market competitiveness of the shredders having the blades.

In summary, the revolutionary structure of a shredder blade made by punching and bending that is integrally made by punching a metal sheet having a thickness of about 0.6 mm by a punching die to form a blade body having a circular periphery, where the circular periphery is formed into a serrated cutting edge therearound, and symmetrical cutting portions, connecting portions and supports extending outwards from a top and a bottom transections of the blade body, wherein the cutting portions, connecting portions and supports are first pressed towards a first direction such that they protrude from a major side of the blade body, and the cutting portions and connecting portions are bent towards the opposing second direction to form cutting edges, wherein relative movements of the cutting edges cut paper along a longitudinal direction to form strips, and the cutting edges then cut the strips along a horizontal direction to fragment the strips into chips, can effectively reduce the material cost and the weigh of the blade to thereby reduce the motor loading and power consumption, while enhancing market competitiveness of the shredders having the blades. This invention satisfies the criterion for novelty.

The above embodiments are intended for describing this invention without limiting the scope that this invention may be applied. Modifications made in accordance with the disclosures of this invention without departing from the spirits of this invention are within the scope of this invention.

What is claimed is:

1. A shredder blade, made of a sheet metal by a punching die to form a blade body having a circular periphery, wherein the blade body is formed with top and bottom transections on the circular periphery; symmetrical cutting portions; connecting portions and supports extending outwards from the transections; a senated cutting edge integrally formed anund a remaining periphery of the blade body; and a polygonal central hole through which a rotary shaft may pass; and wherein the cutting portions, connecting portions and supports are pressed towards a first direction to protrude from a major side of the blade body, and the cutting portions and supports are then bent towards an opposing second direction such that the resulting cutting edges are substantially configured into a right triangle.

2. The shredder blade made by punching and bending according to claim 1 wherein the blade body is formed with an annular crease that is punched along an inbound of the circular peripheiy to enhance bending resistance of the blade body.

* * * * *